US005421851A

United States Patent [19]

Oskarsson et al.

[11] Patent Number: 5,421,851

[45] Date of Patent: Jun. 6, 1995

[54] SINTERED CARBONITRIDE ALLOY WITH CONTROLLED GRAIN SIZE

[75] Inventors: Rolf G. Oskarsson, Ronninge; Gerold Weinl, Alvsjo; Ake Ostlund, Taby, all of Sweden

[73] Assignee: Sandvik AB, Sandviken, Sweden

[21] Appl. No.: 878,984

[22] Filed: May 6, 1992

[30] Foreign Application Priority Data

May 7, 1991 [SE] Sweden ..... 9101385

[51] Int. Cl.[6] ..... C22C 29/04

[52] U.S. Cl. ..... 75/238; 75/239; 75/240; 75/241; 75/242; 75/244; 419/13; 419/14; 419/15; 419/16; 419/23; 419/32; 419/38

[58] Field of Search ..... 75/241, 242, 244, 246, 75/238–240; 419/13, 14, 15, 16, 23, 32, 38

[56] References Cited

U.S. PATENT DOCUMENTS

| | | | |
|---|---|---|---|
| 3,971,656 | 7/1976 | Rudy | 75/203 |
| 4,857,108 | 8/1989 | Brandt et al. | 75/238 |
| 4,885,132 | 12/1989 | Brandt et al. | 419/15 |
| 4,944,800 | 7/1990 | Kolaska et al. | 75/238 |
| 4,957,548 | 9/1990 | Shima et al. | 75/238 |
| 4,966,627 | 10/1990 | Keshavan et al. | 75/240 |
| 4,985,070 | 1/1991 | Kitamura et al. | 75/238 |

FOREIGN PATENT DOCUMENTS

| | | |
|---|---|---|
| 0417302 | 3/1991 | European Pat. Off. . |
| 61-295352 | 5/1987 | Japan . |
| 62-237740 | 6/1989 | Japan . |

OTHER PUBLICATIONS

Patent Abstracts of Japan vol. 013, No. 111 (C-577) 16 Mar. 1989 & JP-A-63 286 549 (Toshiba Tungalloy Co Ltd) 19 May 1987.

Patent Abstracts of Japan vol. 014, No. 261 (C-725) 6 Jun. 1990 & JP-A-20 73 946 (Toshiba Tungalloy Co Ltd) 13 Mar. 1990.

*Primary Examiner*—Ngoclan T. Mai

*Attorney, Agent, or Firm*—Burns, Doane, Swecker & Mathis

[57] ABSTRACT

The present invention relates to a sintered titanium-based carbonitride alloy for milling and turning where the hard constituents are based on Ti, Zr, Hf, V, Nb, Ta, Cr, Mo and/or W and the binder phase based on Co and/or Ni. The structure comprises 10–50% by volume hard constituent grains with core-rim-structure with a mean grain size for the cores of 2–8 μm in a more fine-grained matrix with a mean grain size of the hard constituents of <1 μm and where said mean grain size of the coarse hard constituents grains is >1.5 μm, preferably >2 μm, larger than the mean grain size for the grains in the matrix. The coarse grains can be Ti(C,N), (Ti,Ta)C, (Ti,Ta)(C,N) and/or (Ti,Ta,V)(C,N).

5 Claims, 1 Drawing Sheet

SINTERED CARBONITRIDE ALLOY WITH CONTROLLED GRAIN SIZE

BACKGROUND OF THE INVENTION

The present invention relates to a sintered carbonitride alloy having titanium as main component intended for use as an insert for turning and milling. By a proper choice of grain sizes, the alloy has been given improved wear resistance without an accompanying decrease in toughness.

Classic cemented carbide, i.e., based upon tungsten carbide (WC) and cobalt (Co) as binder phase, has in the last few years met with increased competition from titanium-based hard materials, usually called cermets. In the beginning these titanium-based alloys were based on TiC+Ni and were used only for high speed finishing because of their extraordinary wear resistance at high cutting temperatures. This property depends essentially upon the good chemical stability of these titanium-based alloys. The toughness behavior and resistance to plastic deformation were not satisfactory, however, and therefore the area of application was relatively limited.

Development proceeded and the range of application for sintered titanium-based hard materials has been considerably enlarged. The toughness behavior and resistance to plastic deformation have been considerably improved. This has been done, however, by partly sacrificing the wear resistance.

An important development of titanium-based hard alloys is the substitution of carbides by nitrides in the hard constituent phase. This decreases the grain size of the hard constituents in the sintered alloy. Both the decrease in grain size and the use of nitrides lead to the possibility of increasing the toughness at unchanged wear resistance. Characteristic for said alloys is that they are usually considerably more fine-grained than normal cemented carbide, i.e., WC-Co-based hard alloy. Nitrides are also generally more chemically stable than carbides which results in lower tendencies to stick to work piece material or wear by solution of the tool, the so-called diffusion wear.

In the binder phase, the metals of the iron group, i.e., Fe, Ni and/or Co, are used. In the beginning, only Ni was used, but nowadays both Co and Ni are often found in the binder phase of modern alloys. The amount of binder phase is generally 3–25% by weight.

Besides Ti, the other metals of the groups IVa, Va and VIa, i.e., Zr, Hf, V, Nb, Ta, Cr, Mo and/or W, are normally used as hard constituent formers as carbides, nitrides and/or carbonitrides. There are also other metals used, for example Al, which sometimes are said to harden the binder phase and sometimes improve the wetting between hard constituents and binder phase, i.e., facilitate the sintering.

A very common structure in alloys of this type is hard constituent grains with a core-rim-structure. An early patent in this area is U.S. Pat. No. 3,971,656 which comprises Ti- and N-rich cores and rims rich in Mo, W and C.

It is known through U.S. patent application Ser. No. 07/543,474 (our reference: 024000-757), which is herein incorporated by reference, that at least two different combinations of duplex core-rim-structures in well-balanced proportions give optimal properties regarding wear resistance, toughness behavior and/or plastic deformation.

OBJECTS AND SUMMARY OF THE INVENTION

It is an object of this invention to avoid or alleviate the problems of the prior art.

It is particularly an object of this invention to provide an insert for milling and cutting of a titanium-based carbonitride alloy which has increase resistance to wear on the rake face of the insert.

In one aspect of the invention there is provided a sintered titanium-based carbonitride alloy for milling and turning containing hard constituents based on Ti, Zr, Hf, V, Nb, Ta, Cr, Mo and/or W and 3–25% binder phase based on Co and/or Ni, said sintered alloy comprising 10–50% by volume hard constituent grains with core-rim-structure with a mean grain size for the core of 2–6 μm in a more fine-grained matrix, the mean grain size of the fine-grained hard constituents in said matrix being $<1$ μm, and the mean grain size of the coarse hard constituent grains being $>1.5$ μm larger than the mean grain size for the fine grains in said matrix.

In another aspect of the invention there is provided a method of making a sintered insert for milling or turning comprising a titanium-based carbonitride containing hard constituents based on Ti, Zr, Hf, V, Nb, Ta, Cr, Mo and/or W and 3–25% binder phase based on Co an/or Ni wherein at least one hard constituent and binder phase metal are milled, a second hard constituent is added at a later time during the milling, the milled powders are pressed and sintered to form hard constituent grains with the core-rim-structure, and the mean grain size for the core of the hard constituent grains being 2–6 μm in a more fine-grained matrix, the mean grain of the fine-grained hard constituents being $<1$ μm, the mean grain size of the coarse hard constituent grains being $>1.5$ μm larger than the mean grain size of the fine grains in said matrix.

DETAILED DESCRIPTION OF THE PREFERRED EMBODIMENTS OF THE INVENTION

The present invention relates to a sintered carbonitride alloy with at least two different grain sizes and grain size distributions. It has turned out that it is possible to further increase the level of performance by providing the sintered material with different grain sizes. It is mainly the ability to withstand wear, i.e., wear resistance, which can be increased without corresponding decrease of the toughness behavior by providing the material with coarse grains which essentially consists of coarser cores which in their turn get rims during the sintering/cooling. In this way, the crater wear resistance is increased, i.e., the wear on the rake face (that face on which the chips slide) decreases, without the expected loss of toughness behavior. The coarse cores give a very unexpected effect in the form of changed wear mechanism. On one hand, the wear pattern on the rake face is changed with a considerably decreased tendency to clad to work piece material. On the other hand, the movement of the resulting crater toward the edge is considerably retarded. This retardation is much greater than what can be expected from the depth of the crater. The characteristic property for titanium-based carbonitride alloy inserts compared to conventional cemented carbide inserts is their good resistance against flank wear, i.e., wear on the side, that slides against the work piece. Decisive for the life length is therefore most often the crater wear and how this crater moves out toward the edge resulting finally in crater breakthrough which leads to complete insert failure.

Figure 3:
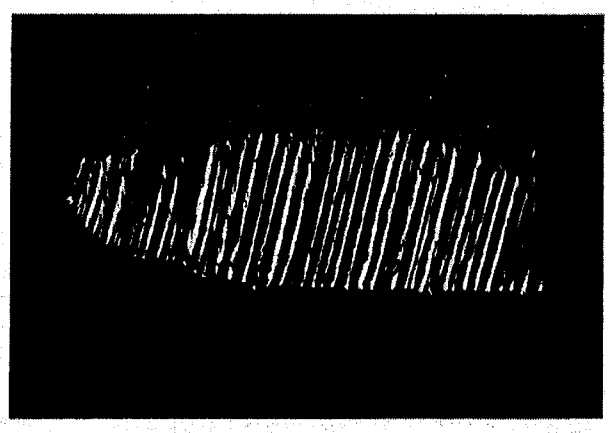
FIG. 3 shows crater wear in 60 X for an insert according to known technique.
Figure 4:
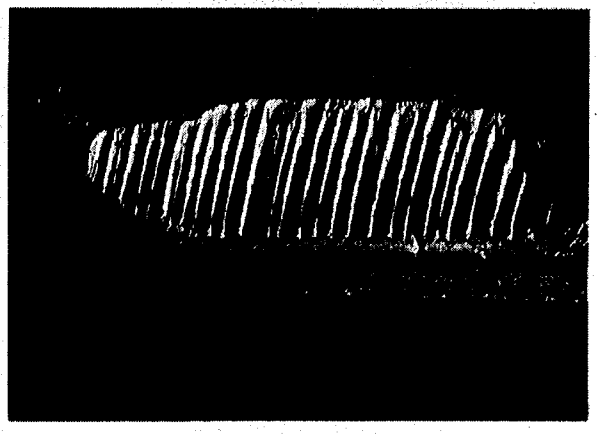
FIG. 4 shows crater wear in 60 X for an insert according to the present invention.

The wear pattern on the rake face (crater wear) of inserts according to known technique is shown in FIG. 3 and according to the present invention in FIG. 4. The resulting crater wear of inserts according to the invention gets coarser relative to known technique, with more well-developed grooves. The distance between the peaks of the grooves is according to the invention 40–100 μm and the main part with a height of >12 μm.

Figure 1:
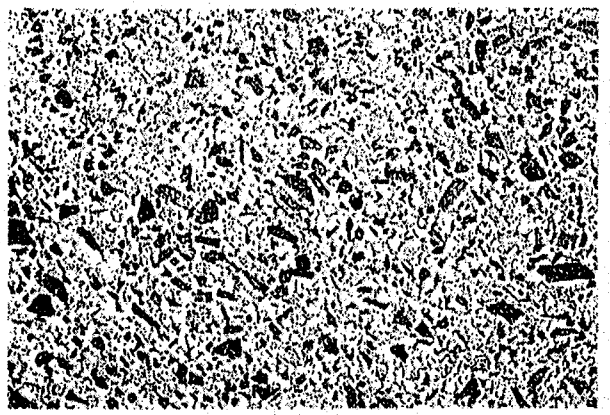
FIG. 1 shows the microstructure in 4000 X of a titanium-based carbonitride alloy according to the known technique.
Figure 2:
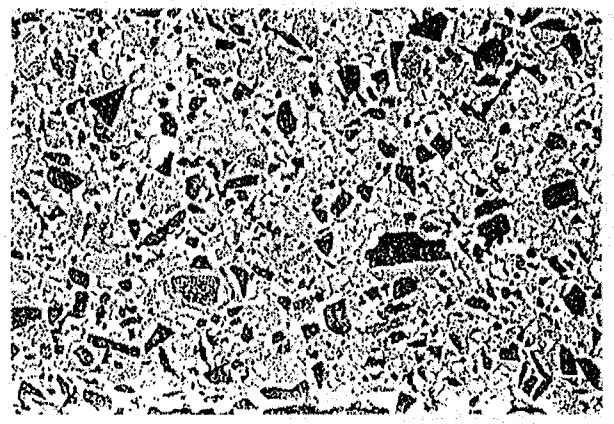
FIG. 2 shows the microstructure in 4000 X of a titanium-based carbonitride alloy according to the present invention.

The titanium-based alloy according to the invention has a fine-grained matrix with a mean grain size of <1 μm in which is evenly distributed coarser, wear resistance increasing grains with a core-rim-structure with a mean grain size for the cores of 2–8 μm, preferably 2–6 μm. The mean thickness of the rim is preferably <25% of the mean diameter of the core. The difference in said mean grain size between the two grain fractions shall preferably be >1.5 μm, most preferably >2 μm. Suitable volume portions of the larger hard constituents is 10–50%, preferably 20–40%. FIG. 1 shows the microstructure of an alloy according to known technique and FIG. 2 according to the present invention. In particular, the alloy according to the present invention can contain at least two, preferably at least three, different core-rim combinations.

The invention also relates to a method of manufacturing a titanium-based carbonitride alloy with powder metallurgical methods, namely, milling, pressing and sintering. The powdery raw materials can be added as single compound, e.g., TiN and/or as a complex compound, e.g., (Ti,Ta,V)(C,N). The desired 'coarse grain material' can be added as an additional coarse-grained raw material. It can also be added, e.g., after ¼, ½ or ¾ of the total milling time. In this way, the grains which shall give the extra wear resistance contribution are not milled for as long a time. If this material has good resistance against mechanical disintegration, it is even possible to use a raw material which does not have coarser grain size than remaining raw materials but which nevertheless gives a considerable contribution to increased grain size of the desired hard constituent. The 'coarse grain material' can comprise one or more raw materials. It can also be of the same type as the fine grain part.

It has turned out to be particularly favorable if a raw material such as Ti(C,N), (Ti,Ta)C, (Ti,Ta)(C,N) and/or (Ti,Ta,V)(C,N) is added as coarser grains because such grains have great resistance against disintegration and are stable during the sintering process, i.e., have low tendency to dissolution. A less suitable type of hard constituent to use for the above-described wear resistance increasing mechanism is, e.g., WC and/or $Mo_2C$. These two carbides are the first to be dissolved in the binder phase and then during sintering and cooling precipitated as rims on undissolved grains.

The invention is additionally illustrated in connection with the following Examples which are to be considered as illustrative of the present invention. It should be understood, however, that the invention is not limited to the specific details of the Examples.

EXAMPLE 1

A powder mixture with a total composition of (Ti,W-,Ta,Mo)(C,N) and (Co,Ni) binder phase starting from different raw materials such as: Ti(C,N), (Ti,Ta)(C,N), WC, $Mo_2C$ and (Ti,Ta)C was manufactured of the following composition in % by weight: 15 W, 39.2 Ti, 5.9 Ta, 8.8 Mo, 11.5 Co, 7.7 Ni, 9.3 C, and 2.6N.

The powder was mixed in a ball mill. All raw materials were milled from the beginning and the milling time was 33 hours (Variant 1).

Another mixture was manufactured according to the present invention with identical composition but with the difference that the milling time for Ti(C,N) materials was reduced to 25 hours (Variant 2).

Milling inserts of type SPKN 1203EDR were pressed of both mixtures and were sintered under the same condition. The mean grain size of Variant 1 after sintering was 0.9 μm while the mean grain sizes of Variant 2 after sintering was 0.9 μm and 3.0 μm respectively. Variant 2 obtained a considerable greater amount of coarse grains due to the shorter milling time for the Ti(C,N) raw material than in Variant 1.

Both variants were tested in a basic toughness test as well as in a wear resistance test. The relative toughness expressed as the feed where 50% of the inserts had gone to fracture was the same for both variants.

A wear resistance test was thereafter performed with the following data:

Work piece material: SS1672
Speed: 285 m/rain
Table Feed: 87 mm/min
Tooth Feed: 0.12 ram/insert
Cutting Depth: 2 mm The wear for both variants was measured continuously. It turned out that the resistance to flank wear was the same for both variants whereas the resistance to crater wear, measured as the depth of the crater, KT, was 20% better for Variant 2. The crater resulting from the crater wear had in Variant 2 coarser, more well-developed grooves with a mutual distance between their peaks of 64 μm and with ~70% of the grooves having a depth of >15 μm, FIGS. 2 and 4, than Variant 1, FIGS. 1 and 3 with a mutual distance between their peaks of 42 μm and with ~10% of the grooves having a depth of >15 μm.

Due to the changed wear mechanism for inserts according to the present invention, the measured KT-values do not give sufficient information about the ability to counteract the move of the crater toward the edge. It is, however, this mechanism that finally decides the total life, i.e., the time to crater breakthrough.

In an extended wear test, i.e, determination of the time until the inserts have been broken, performed as 'one tooth milling' with the above cutting dam it turned out that there is a greater difference in tool life between the variants than indicated by the KT-values. Variant 1 had a mean life of 39 minutes (which corresponds to a milled length of 3.4 m) whereas the mean tool life of Variant 2 was 82 minutes corresponding to a milled length of 7.2 m, i.e., an improvement of >2 times.

EXAMPLE 2

A powder mixture with a total composition of (Ti,W-,Ta,Mo,V)(C,N) and (Co,Ni) binder phase but from different raw materials such as: Ti(C,N), (Ti,Ta)C, $Mo_2C$, WC and VC was manufactured with the following composition in % by weight: 14.9 W, 38.2 Ti, 5.9 Ta, 8.8 Mo, 3.2 V, 10.8 Co, 5.4 Ni, 8.4 C, and 4.4N.

The powder was mixed in a ball mill. All raw materials were milled from the beginning and the milling time was 38 hours (Variant 1).

Another mixture according to the invention was manufactured with identical composition but with the difference that the milling time for only the Ti(C,N) raw material was reduced to 28 hours (Variant 2). All other compounds were milled 38 hours.

Turning inserts of type TNMG 160408 QF were pressed of both mixtures and were sintered at the same occasion. Even in this case, a considerable difference in grain size could be observed. The mean grain size of Variant 1 after sintering was 0.8 μm while the mean grain sizes of Variant 2 after sintering was 0.8 μm and 3.5 μm respectively.

Technological testing with regard to basic toughness showed no difference at all between the variants. On the other hand, the same observation as in the previous Example could be done, i.e., a retardation of the growth of the crater toward the edge. The following cutting data were used:

Work piece material: SS2541

Speed: 3 15 m/rain

Feed: 0.15 mm.rev

Cutting Depth: 0.5 mm

The mean tool life for Variant 2 was 18.3 minutes which is 60% better than Variant 1 which worked in the average 11.5 minutes. In all cases, crater breakthrough was life criterium. The flank wear resistance was the same for both variants. The depth of the crater wear, KT, could not be determined due to the chip breaker.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered titanium-based carbonitride alloy for milling and turning containing hard constituents selected from the group consisting of carbides, nitrides or carbonitrides of Ti, Zr, Hf, V, Nb, Ta, Cr, Mo, W and mixtures thereof with titanium as the main component and 3–25% binder phase of a metal selected from the group selected from Co, Ni and alloys thereof, said sintered alloy comprising 10–50% by volume hard constituent grains with core-rim-structure with a mean grain size for the core of 2–6 μm in a matrix containing hard constituents of a finer grain size, the mean grain size of the fine-grained hard constituents in said matrix being $<1$ μm, and the mean grain size of the said hard constituent grains having core-rim structures with a mean grain size of the core of 2–6 μm being $>2$ μm larger than the mean grain size for the fine grains in said matrix.

2. The sintered carbonitride alloy of claim 1 wherein the coarse grains comprise Ti(C,N), (Ti,Ta)C, (Ti,-Ta)(C,N) and/or (Ti,Ta,V)(C,N).

3. An insert for milling and turning of the alloy of claim 1.

4. The sintered insert for milling and turning of claim 3 wherein the bottom of a crater caused by crater wear during milling and turning on the rake face of said insert contains grooves with a mutual distance between their peaks of 40–100 μm and the depth of the grooves being mainly $>12$ μm.

5. A method of making a sintered insert for milling or turning comprising a titanium-based carbonitride containing hard constituents selected from the group consisting of carbides, nitrides or carbonitrides of Ti, Zr, Hf, V, Nb, Ta, Cr, Mo, W and mixtures thereof with titanium as the main component and 3–25% binder phase of a metal selected from the group consisting of Co, Ni and alloys thereof wherein at least one hard constituent and binder phase metal are milled, a second hard constituent is added at a later time during the milling, the milled powders are pressed and sintered to form hard constituent grains with the core-rim-structure, and the mean grain size for the core of the hard constituent grains being 2–6 μm in a matrix containing hard constituents of a finer grain size, the mean grain size of the fine-grained hard constituents being $<1$ μm, the mean grain size of the said hard constituent grains having core-rim structures with a mean grain size of the core of 2–6 μm being $>2$ μm larger than the mean grain size of the fine grains in said matrix.

* * * * *